US009979122B1

(12) United States Patent
Nakamura

(10) Patent No.: US 9,979,122 B1
(45) Date of Patent: May 22, 2018

(54) ELECTRONIC DEVICE AND CONNECTOR

(71) Applicant: JAPAN AVIATION ELECTRONICS INDUSTRY, LIMITED, Tokyo (JP)

(72) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days. days.

(21) Appl. No.: 15/696,285

(22) Filed: Sep. 6, 2017

(30) Foreign Application Priority Data

Oct. 28, 2016 (JP) ..... 2016-211772

(51) Int. Cl.

| | |
|---|---|
| ***H01R 13/68*** | (2011.01) |
| ***H01R 13/58*** | (2006.01) |
| ***H01R 12/77*** | (2011.01) |
| ***H01R 12/81*** | (2011.01) |
| ***H01R 12/75*** | (2011.01) |
| ***H01R 13/627*** | (2006.01) |
| *H01R 12/70* | (2011.01) |

(52) U.S. Cl.
CPC ..... *H01R 13/582* (2013.01); *H01R 12/75* (2013.01); *H01R 12/778* (2013.01); *H01R 12/81* (2013.01); *H01R 13/6273* (2013.01); *H01R 12/707* (2013.01)

(58) Field of Classification Search
CPC ..... H01R 13/68; H01H 85/2035; H01H 85/2045; H01H 85/542
USPC ..... 439/620.3, 620.33, 620.34, 620.26, 439/620.28, 620.29
See application file for complete search history.

(56) References Cited

U.S. PATENT DOCUMENTS

| | | | | |
|---|---|---|---|---|
| 3,120,987 A * | 2/1964 | Degnan | ..... | H01R 13/5213 439/588 |
| 3,832,676 A * | 8/1974 | Joly | ..... | H01H 9/104 439/620.29 |
| 6,290,540 B1 | 9/2001 | Nishio et al. | | |
| 6,454,604 B1 * | 9/2002 | Currie | ..... | H01R 13/6675 439/606 |

(Continued)

FOREIGN PATENT DOCUMENTS

| | | |
|---|---|---|
| CA | 1117199 A | 1/1982 |
| JP | S56-11864 A | 2/1981 |

(Continued)

OTHER PUBLICATIONS

Extended European Search Report dated Feb. 23, 2018 in European Application No. 17193343.5.

*Primary Examiner* — Phuong Chi T Nguyen
(74) *Attorney, Agent, or Firm* — Collard & Roe, P.C.

(57) ABSTRACT

A second connector of an electronic device is mateable with and removable from a first connector along a front-rear direction. The second connector has a cable protection portion which is located on a protected portion of a cable to protect the protected portion. The cable is led out from the cable protection portion in a direction intersecting with the front-rear direction. The first connector has a receiving portion and a regulating portion. The receiving portion receives the cable protection portion at least in part in a state that the first connector is mated with the second connector. The regulating portion is located above the cable protection portion in an up-down direction and overlaps with the cable protection portion in the state that the first connector is mated with the second connector.

10 Claims, 10 Drawing Sheets

(56) References Cited

U.S. PATENT DOCUMENTS

| | | | | |
|---|---|---|---|---|
| 7,914,306 | B1 * | 3/2011 | Blackwell ..... | H01R 13/5213<br>439/135 |
| 8,297,992 | B2 * | 10/2012 | Park ..... | H01R 13/6295<br>439/157 |
| 2005/0181661 | A1 | 8/2005 | Kaneko et al. | |
| 2011/0306229 | A1 | 12/2011 | Katsui et al. | |
| 2014/0030917 | A1 | 1/2014 | Mason et al. | |
| 2016/0172789 | A1 | 6/2016 | Li et al. | |

FOREIGN PATENT DOCUMENTS

| | | | |
|---|---|---|---|
| JP | H09-306583 | A | 11/1997 |
| JP | H10-247557 | A | 9/1998 |
| JP | 2001-126812 | A | 5/2001 |
| JP | 2005-019075 | A | 1/2005 |
| JP | 2012-003874 | A | 1/2012 |
| JP | 5-917901 | B2 | 5/2016 |

* cited by examiner

ELECTRONIC DEVICE AND CONNECTOR

CROSS REFERENCE TO RELATED APPLICATIONS

This application is based on and claims priority under 35 U.S.C. § 119 to Japanese Patent Application No. JP2016-211772 filed Oct. 28, 2016, the contents of which are incorporated herein in their entirety by reference.

BACKGROUND OF THE INVENTION

This invention relates to an electronic device and a connector which is included in the electronic device.

As a connector used in an electronic device, there is an example described in JPA 2012-3874 (Patent Document 1).

As shown in FIG. 18, the connector 900 described in Patent Document 1 has a receptacle connector 910 and a plug connector 920. The receptacle connector 910 is mounted on a printed circuit board (not shown). On the other hand, to the plug connector 920, cables 930 are connected. The plug connector 920 is inserted into the receptacle connector 910 so that the plug connector 920 and the receptacle connector 910 are mated and electrically connected with each other.

SUMMARY OF THE INVENTION

The connector 900 described in Patent Document 1 has a problem of a possibility that cable lead-out portions of the plug connector 920 are damaged when the cables 930 are swung in a state that the receptacle connector 910 and the plug connector 920 are mated with each other.

It is an object of the present invention to provide an electronic device including a connector which is provided with a structure to prevent a cable lead-out portion from being damaged.

One aspect of the present invention provides an electronic device which comprises a circuit board, a first connector mounted on the circuit board, a cable having a protected portion and a second connector attached to the cable. The second connector is mateable with and removable from the first connector along a front-rear direction. The second connector has a cable protection portion to protect the protected portion of the cable. The cable protection portion is located on the protected portion in an up-down direction perpendicular to the front-rear direction in a state that the second connector is mated with the first connector. The cable is led out from the cable protection portion in a direction intersecting with the front-rear direction. The first connector has a receiving portion and a regulating portion. The receiving portion receives the cable protection portion at least in part in the state that the second connector is mated with the first connector. The regulating portion is positioned above the cable protection portion and overlaps with the cable protection portion in the up-down direction in the state that the second connector is mated with the first connector.

Another aspect of the present invention provides a connector which is mateable with a mating connector along a front-rear direction. The mating connector is attached to a cable having a protected portion. The mating connector has a cable protection portion to protect the protected portion of the cable. The cable protection portion is located on the protected portion in an up-down direction perpendicular to the front-rear direction in a state that the mating connector is mated with the connector. The cable is led out from the cable protection portion in a direction intersecting with the front-rear direction. The connector has a receiving portion and a regulating portion. The receiving portion receives the cable protection portion at least in part in the state that the mating connector is mated with the connector. The regulating portion is located above the receiving portion and overlaps with the receiving portion in the up-down direction.

In the electronic device of the present invention, on the protected portion of the cable, the cable protection portion is provided. In the state that the first connector and the second connector are mated with each other, the regulating portion is positioned above the cable protection portion and overlaps with the cable protection portion. With this structure, when the cable is swung, movement of the cable is suppressed, and the cable lead-out portion of the connector is prevented from being damaged.

An appreciation of the objectives of the present invention and a more complete understanding of its structure may be had by studying the following description of the preferred embodiment and by referring to the accompanying drawings.

Figure 1:
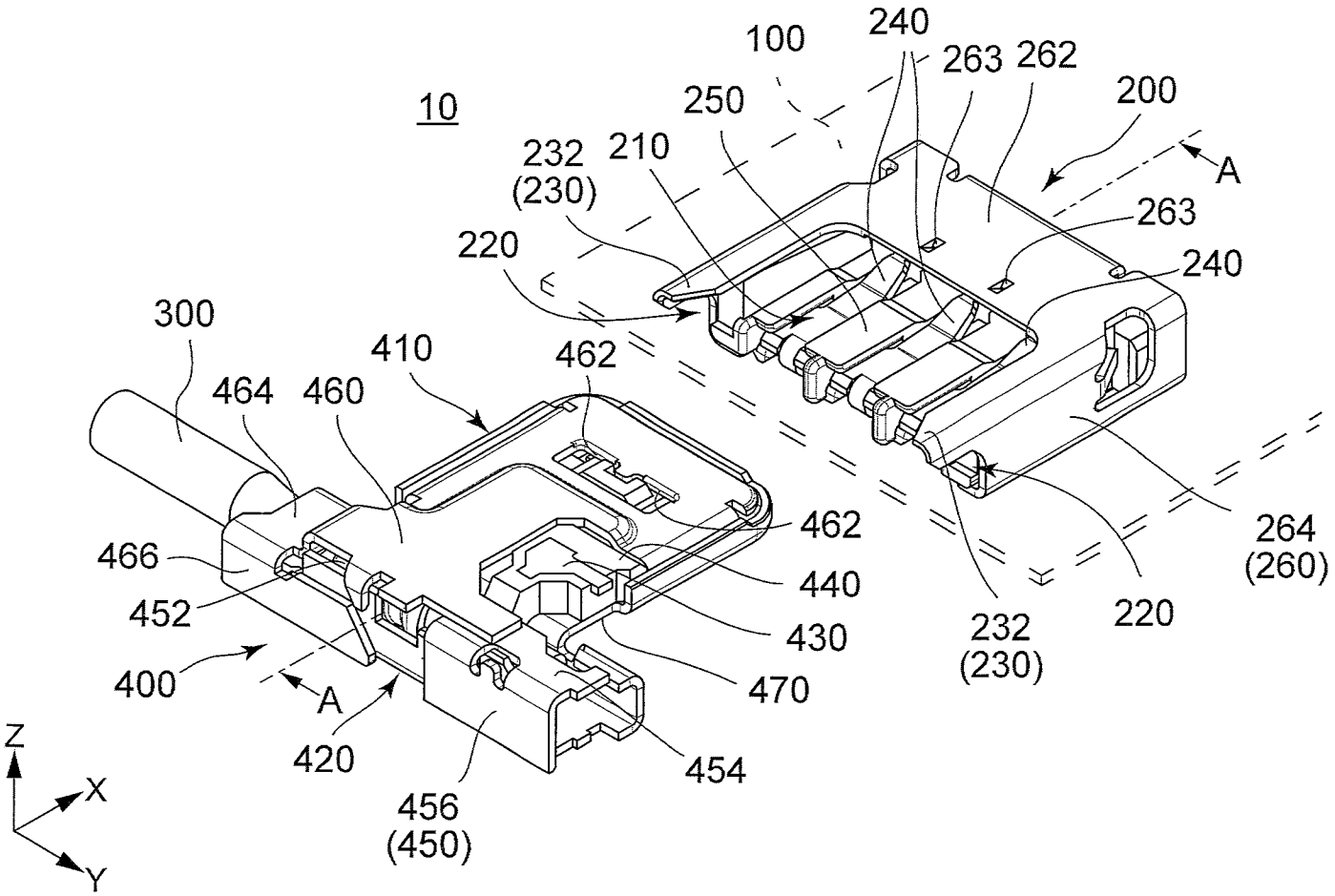
FIG. 1 is a perspective view showing a first connector and a second connector which are included in an electronic device according to a first embodiment of the present invention. The first connector and the second connector are not yet mated with each other. A circuit board on which the first connector is mounted is indicated by broken lines.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
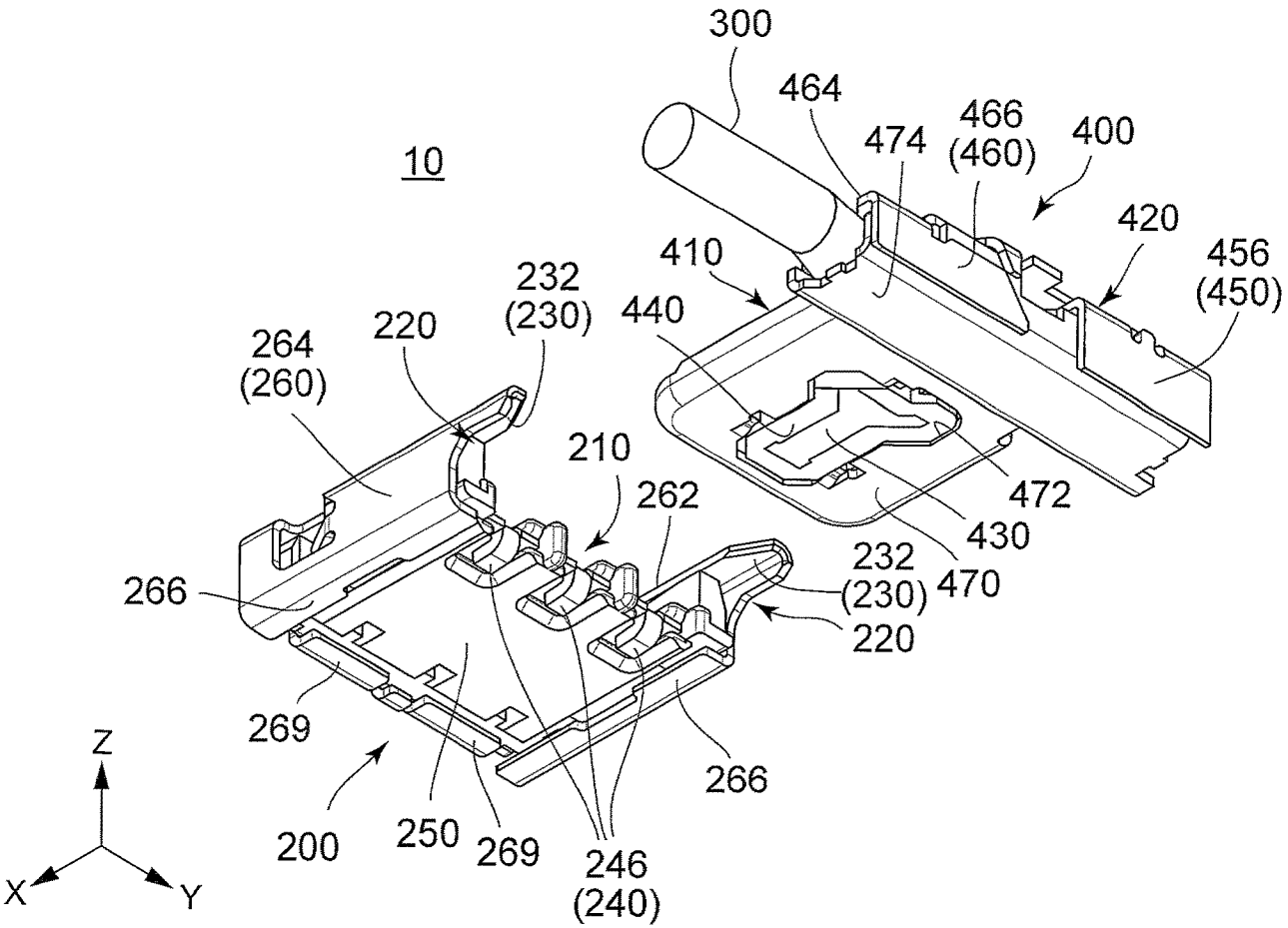
FIG. 2 is another perspective view showing the first connector and the second connector of FIG. 1.

Referring to FIGS. 1 and 2, an electronic device 10 according to a first embodiment of the present invention is provided with a circuit board 100, a first connector 200 mounted on the circuit board 100, a cable 300, a second connector 400 attached to an end portion of the cable 300. In the present embodiment, the circuit board 100 is a printed circuit board (PCB). However, the present invention is not limited thereto. For example, the circuit board 100 may be a flexible printed circuit (FPC) or a flexible flat cable (FFC). Moreover, in the present embodiment, the cable 300 is a coaxial cable. However the present invention is not limited thereto. The cable 300 may be a multi-conductor cable.

As understood from FIGS. 1 to 4, the second connector 400 is mateable with and removable from the first connector 200 along a front-rear direction. In the present embodiment, the front-rear direction is an X-direction. A negative X-direction is directed forward while a positive X-direction is directed rearward.

Figure 5:
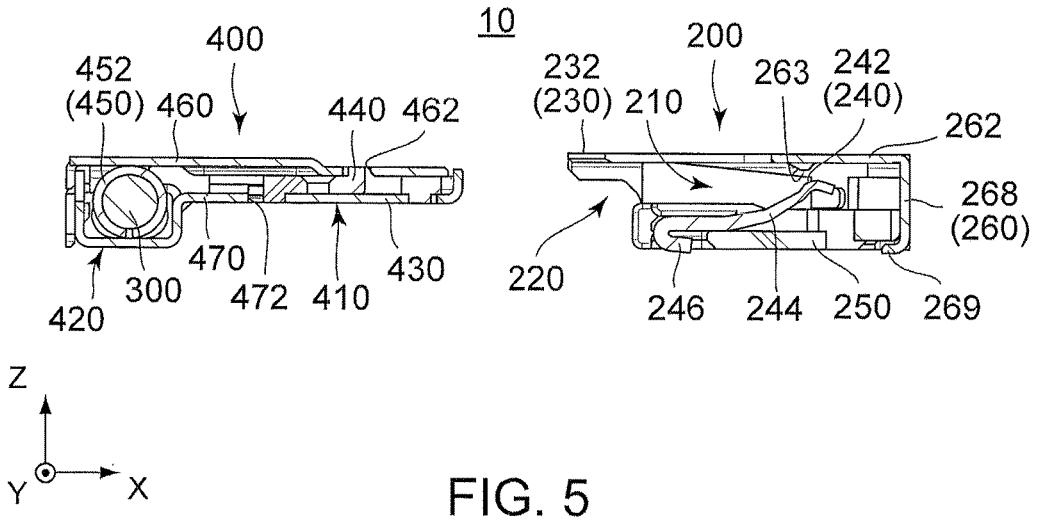
FIG. 5 is a cross-sectional view showing the first connector and the second connector of FIG. 1, taken along A-A line. A cable to be connected to the second connector is simplified to be depicted.

As shown in FIGS. 1, 2 and 5, the second connector 400 has an accommodated portion 410 and a cable attaching portion 420. The accommodated portion 410 is accommodated in the first connector 200 at least in part. The cable attaching portion 420 is located forward of the accommodated portion 410. The accommodated portion 410 has a board shape which is slightly long in the front-rear direction. The cable attaching portion 420 has an almost rectangular parallelepiped shape which is long in a direction intersecting with the front-rear direction.

As understood from FIGS. 1, 2 and 5, the second connector 400 is composed of a second terminal 430, a second holding member 440, a fixing plate 450, an upper plate 460 and a lower plate 470. The second holding member 440 holds the second terminal 430. The fixing plate 450 fixes the cable 300. The upper plate 460 and the lower plate 470 are combined with each other and cover the second holding member 440 at least in part. The accommodated portion 410 includes the second terminal 430, the second holding member 440, a part of the upper plate 460 and a part of the lower plate 470. The cable attaching portion 420 includes the fixing plate 450, the remaining part of the upper plate 460 and the remaining part of the lower plate 470.

The second terminal 430 is made of metal. The second holding member 440 is made of insulating resin. The second terminal 430 and the second holding member 440 are integrated with each other by insert molding. As understood from FIGS. 1 and 2, the second terminal 430 is exposed outside from the second holding member 440 in part. Each of the fixing plate 450, the upper plate 460 and the lower plate 470 is formed by punching out a metal plate and bending the punched out metal plate. The fixing plate 450, the upper plate 460 and the lower plate 470 are combined with and fixed to one another. The second terminal 430 and the second holding member 440 are held and fixed between the upper plate 460 and the lower plate 470 which are combined with each other.

Figure 3:
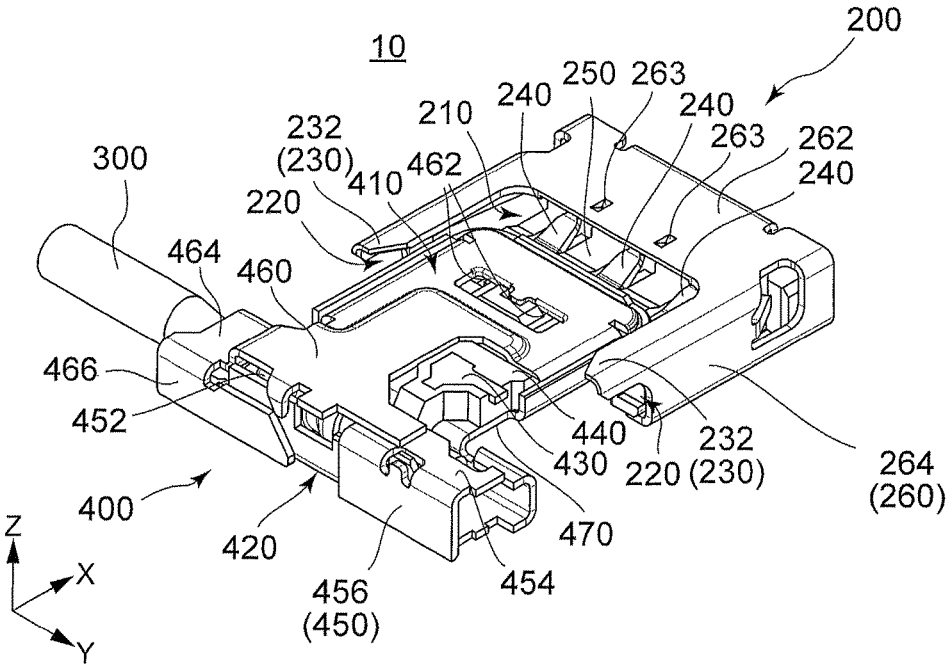
FIG. 3 is still another perspective view showing the first connector and the second connector of FIG. 1. The first connector and the second connector are in a halfway state of a mating motion.

As understood from FIGS. 1 to 5, the fixing plate 450 is attached to the end portion of the cable 300. The fixing plate 450 has a part 452 which is located between the upper plate 460 and the lower plate 470. The fixing plate 450 further has other parts 454 and 456 which form a part of an upper surface and a part of a front surface of the cable attaching portion 420, respectively. The upper plate 460 forms not only a part of an upper surface of the accommodated portion 410 but a part of the upper surface of the cable attaching portion 420. As shown in FIGS. 1, 3 and 5, the upper plate 460 is formed with lock receiving portions 462 in the accommodated portion 410. The lock receiving portions 462 engage with lock protrusions 263 mentioned later. In a state shown in FIGS. 1 and 2, i.e., a state that the second connector 400 can be mated with the first connector 200, the upper plate 460 is located inside the lower plate 470 in the accommodated portion 410 when the second connector 400 is seen from above along an up-down direction as understood from FIGS. 1 and 3. In addition, the upper plate 460 has a part which extends in a lateral direction to form a cable protection portion 464 in the cable attaching portion 420. The upper plate 460 further has another part 466 which extends downward from a front edge of the cable protection portion 464 to form a part of the front surface of the cable attaching portion 420. It should be noted that the up-down direction is a direction perpendicular to the front-rear direction. In the present embodiment, the up-down direction is a Z-direction. A positive Z-direction is directed upward while a negative Z-direction is directed downward. The lateral direction is a direction perpendicular to both of the front-rear direction and the up-down direction. In the present embodiment, the lateral direction is a Y-direction.

As understood from FIGS. 2 and 5, the lower plate 470 forms both lower surfaces of the accommodated portion 410 and the cable attaching portion 420. In the accommodated portion 410, the lower plate 470 is formed with a window 472. In the window 472, the second terminal 430 is exposed in part. In the accommodated portion 410, the second terminal 430 has a surface exposed in the window 472 while the lower plate 470 has a lower surface. The surface of the second terminal 430 that is exposed in the window 472 and the lower surface of the lower plate 470 are in the same plane perpendicular to the up-down direction. The surface of the second terminal 430 that is exposed in the window 472 and the lower surface of the lower plate 470 function in part as second contacts which are brought into contact with first contacts 242, which are mentioned later, of the first connector 200.

Figure 9:
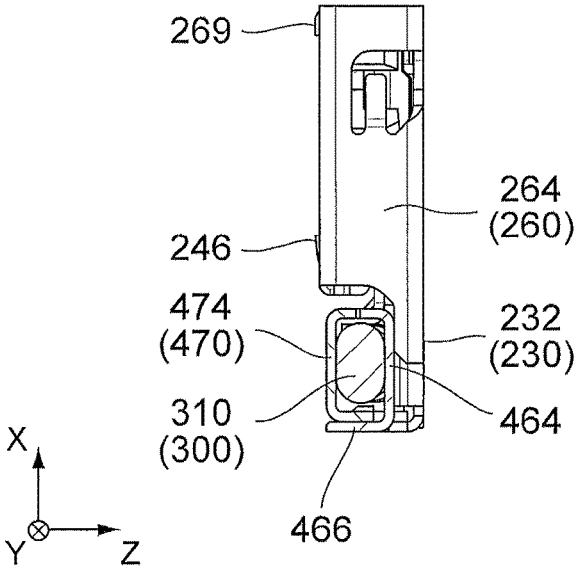
FIG. 9 is a cross-sectional view showing the first connector and the second connector of FIG. 7, taken along B-B line. The cable to be connected to the second connector is simplified to be depicted.

As shown in FIGS. 1 to 4, the cable 300 the end portion of which is fixed by the fixing plate 450 is led out and extends from the cable protection portion 464 of the cable attaching portion 420 in a direction intersecting with the front-rear direction. In the state that the second connector 400 can be mated with the first connector 200, the cable 300 is led out and extends in the lateral direction. As understood from FIG. 9, the cable protection portion 464 is located on a part, i.e. a protected portion 310, of the cable 300 to protect the protected portion 310 of the cable 300. The cable protection portion 464 may merely be in contact with the protected portion 310. However, it is more desirable that the cable protection portion 464 presses the protected portion 310, for prevention of movement of the cable 300. In the present embodiment, the second connector 400 is provided with a supporting portion 474 which supports at least the protected portion 310 of the cable 300. The protected portion 310 is interposed between the supporting portion 474 and the cable protection portion 464. As shown in FIG. 9, the protected portion 310 is sandwiched between the cable protection portion 464 and the supporting portion 474 to be deformed. With this structure, the second connector 400 is thinned. It should be noted that the supporting portion 474 is a part of the lower plate 470.

As shown in FIGS. 1, 2 and 5, the first connector 200 has an approximately flat parallelepiped shape. The first connector 200 has an accommodating portion 210, receiving portions 220 and protruding portions 230. The accommodating portion 210 accommodates the accommodated portion 410 of the second connector 400 at least in part. One of the receiving portions 220 receives the cable protection portion 464 at least in part. The accommodating portion 210 opens upward in part.

As understood from FIGS. 1, 2, 5 and 6, the first connector 200 is composed of a plurality of first terminals 240, a first holding member 250 and a shell 260. In the present embodiment, the first terminals 240 are three in number. The first holding member 250 holds the first terminals 240. The shell 260 surrounds a periphery of the first holding member 250 in part.

The first terminals 240 are made of metal. The first holding member 250 is made of insulating resin. The first terminals 240 are fixed to the first holding member 250 by means of press fitting or the like. The shell 260 is formed by punching out a metal plate and bending the punched out metal plate.

Figure 6:
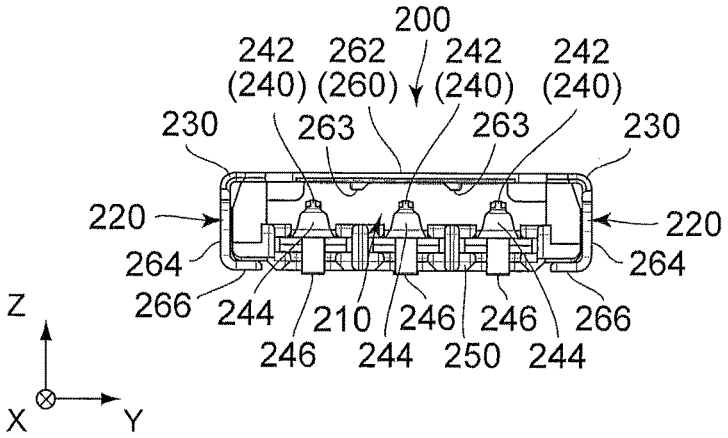
FIG. 6 is a front view of the first connector of FIG. 1.

As understood from FIGS. 1, 2 and 6, the first terminals 240 are arranged in the lateral direction at predetermined intervals. In other words, the first holding member 250 holds the first terminals 240 so that the first terminals 240 are arranged in the lateral direction at the predetermined intervals. As shown in FIGS. 5 and 6, each of the first terminals 240 has the first contact 242, a resilient supporting portion 244 and a fixing portion 246. The fixing portion 246 is connected and fixed to the circuit board 100 by solder or the like. The resilient supporting portion 244 is resiliently deformable and supports the first contact 242 movably in the up-down direction. The first contacts 242 are supported by the resilient supporting portions 244 corresponding to them, respectively. The first contacts 242 are arranged in the lateral direction and protrude upward in the up-down direction. The first contacts 242 are brought into contact with the second contacts and electrically connected to them when the first connector 200 and the second connector 400 are in a mated state that the first connector 200 and the second connector 400 are mated with each other. In detail, each of the first contacts 242 is brought into contact with a part of the surface of the second terminal 430 of the second connector 400 or a part of the lower surface of the lower plate 470 to be electrically connected to it.

As shown in FIGS. 1, 2 and 5, the shell 260 has an upper surface portion 262, a pair of side surface portions 264, a pair of under surface portions 266, a rear surface portion 268 and extension portions 269. The upper surface portion 262 has a short angular U-shape when seen along the up-down direction. The upper surface portion 262 is formed with a pair of the lock protrusions 263 which protrudes downward in the up-down direction. The lock protrusions 263 are formed by punching out the metal plate forming the shell 260. The lock protrusions 263 are located, as shown in FIG. 5, forward of the first contacts 242 in the front-rear direction. Moreover, as shown in FIG. 2, the under surface portions 266 and the extension portions 269 cover a lower surface of the first holding member 250 in part. The under surface portions 266 and the extension portions 269 are used as soldered portions when the first connector 200 is mounted on the circuit board 100. In other words, when the first connector 200 is mounted on the circuit board 100, each of the under surface portions 266 and the extension portions 269 is soldered to the circuit board 100 at least in part.

As understood from FIGS. 1 and 2, the protruding portions 230 are formed by parts of the shell 260. One of the protruding portions 230 serves as a regulating portion as mentioned later. However, the present invention is not limited thereto. The regulating portion may be formed by a part of the first holding member 250. In a case where the regulating portion is formed by the part of the first holding member 250, it needs a large thickness to obtain necessary intensity. Accordingly, it is desirable that the regulating portion is formed by the part of the shell 260.

As understood from FIGS. 1, 2, 5 and 6, each of the protruding portions 230 protrudes forward at a boundary part between the upper surface portion 262 and each of the side surface portions 264. The protruding portions 230 define the receiving portions 220, respectively. The protruding portions 230 are located outward of the first contacts 242 in the lateral direction. However, the present invention is not limited thereto. The protruding portions 230 may be located inward of outermost two of the first contacts 242 in the lateral direction. Also, the protruding portions 230 are located forward of the lock protrusions 263. In other words, the lock protrusions 263 are located between the protruding portions 230 and the first terminals 240 in the front-rear direction. Moreover, each of the protruding portions 230 has a decrement portion 232 of which a width in the lateral direction is gradually reduced from the rear to the front in the front-rear direction. Furthermore, each of the protruding portions 230 has an L-shaped cross section in a plane perpendicular to the front-rear direction. Since the cross section is L-shaped, each of the protruding portions 230 can stand up to a strong external force. However, in the present invention, the cross sectional shape of the protruding portion 230 is not limited to be L-shaped. The protruding portion 230 may have a straight cross section in the plane perpendicular to the front-rear direction. In such a case, the protruding portions 230 may be provided at vicinities of both ends of the upper surface portion 262 in the lateral direction or at vicinities of upper ends of the side surface portions 264. Moreover, in the present embodiment, the shell 260 has the pair of the protruding portions 230. However, the present invention is not limited thereto. The shell 260 may have one of the protruding portions 230 that serves as the regulating portion according to a lead-out or extending direction of the cable 300 in the second connector 400.

Figure 4:
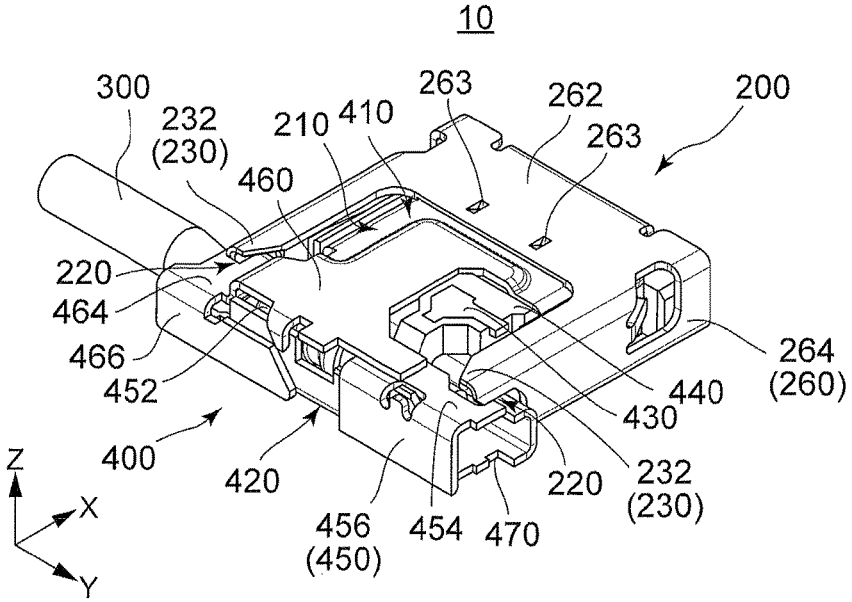
FIG. 4 is a yet another perspective view showing the first connector and the second connector of FIG. 1. The first connector and the second connector are in a mated state.

As understood from FIGS. 3 and 4, when the first connector 200 and the second connector 400 are mated with each other, the decrement portions 232 provided to the protruding portions 230 function as guides to guide the accommodated portion 410 of the second connector 400 into the accommodating portion 210 of the first connector 200. Moreover, the lock protrusions 263 of the first connector 200 are brought into contact with the second connector 400 to adjust an inclination of the second connector 400 in a plane perpendicular to the lateral direction before the first contacts 242 are brought into contact with the second connector 400. Since the inclination of the second connector 400 is adjusted, mating action of the second connector 400 with respect to the first connector 200 can be smoothly performed. If the second connector 400 is brought into contact with the first contacts 242 prior to contacting with the lock protrusions 263, the second connector 400 is pushed by reaction forces of the resilient supporting portion 244 of the first terminals 240 and brought into abutment with the lock protrusions 263. The lock protrusions 263 cannot be moved in the up-down direction. Accordingly, the lock protrusions 263 may disturb the mating action of the second connector 400.

As understood from FIGS. 3 and 4, when the first connector 200 and the second connector 400 are mated with each other, the accommodated portion 410 is accommodated in the accommodating portion 210 at least in part. At the same time, the cable attaching portion 420 is received by the receiving portions 220 in part. At this time, the cable protection portion 464 is positioned in one of the receiving portions 220 at least in part. In other words, the cable protection portion 464 is received by the receiving portion 220 at least in part.

Figure 7:
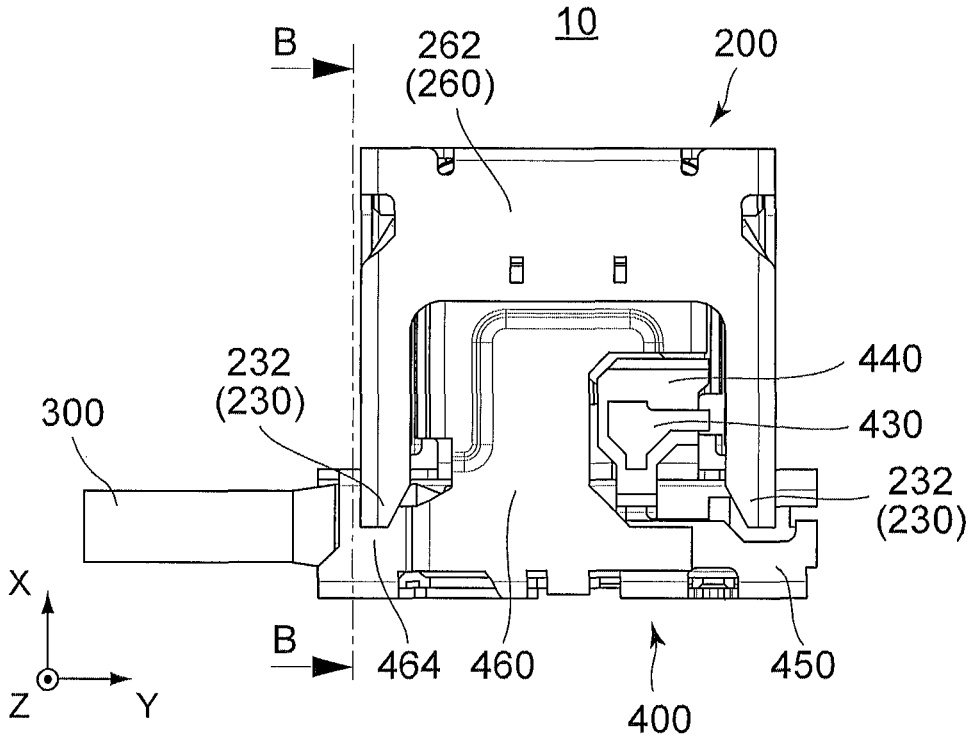
FIG. 7 is a plan view showing the first connector and the second connector of FIG. 4.
Figure 8:
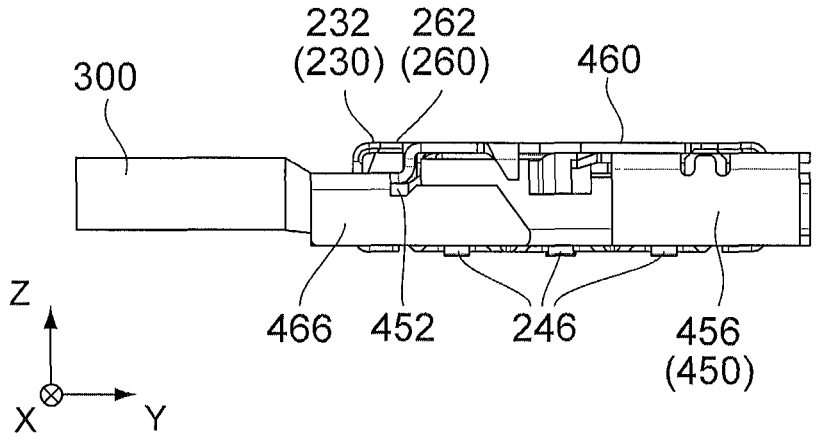
FIG. 8 is a front view showing the first connector and the second connector of FIG. 4.

As understood from FIGS. 7 to 9, in the mated state that the first connector 200 and the second connector 400 are mated with each other, the regulating portion, which is one of the protruding portions 230, is positioned above the cable protection portion 464 in the up-down direction and overlaps with the cable protection portion 464. The regulating portion 230 further overlaps with the protected portion 310 of the cable 300 in the up-down direction. In addition, the cable protection portion 464 and the regulating portion 230 are located outward of the accommodating portion 210 and the accommodated portion 410 in the lateral direction. In this structure, when the cable 300 is swung so that the protected portion 310 and the cable protection portion 464 are moved upward, the cable protection portion 464 is brought into abutment with the regulating portion 230. In other words, the regulating portion 230 regulates upward movement of the cable protection portion 464 and thereby regulating upward movement of the protected portion 310 of the cable 300. In order to reduce a moving distance of the protected portion 310 of the cable 300 and the cable protection portion 464, it is desirable that the regulating portion 230 is in contact with the cable protection portion 464. Moreover, in order to efficiently suppress an influence of swing of the cable 300, it is desirable that the regulating portion 230 is located outward in the lateral direction. In the present embodiment, as seen in FIG. 6, the regulating portion 230 is located outward of the first terminals 240 and the accommodating portion 210 in the lateral direction. With this structure, the movement, caused by swing of the cable 300, of the protected portion 310 and the cable protection portion 464 is effectively suppressed. Thus, in the present embodiment, the regulating portion 230 regulates the upward movement of the protected portion 310 of the cable 300 and thereby preventing a cable lead-out portion of the second connector 400 from being damaged.

Second Embodiment

Figure 10:
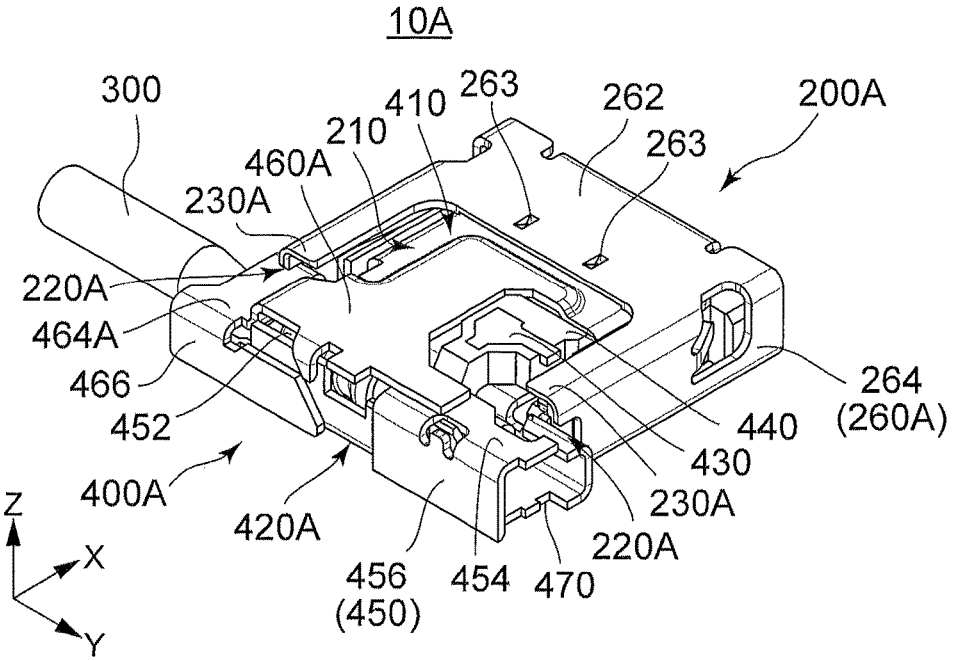
FIG. 10 is a perspective view showing a first connector and a second connector which are included in an electronic device according to a second embodiment of the present invention. The first connector and the second connector are in a mated state.
Figure 11:
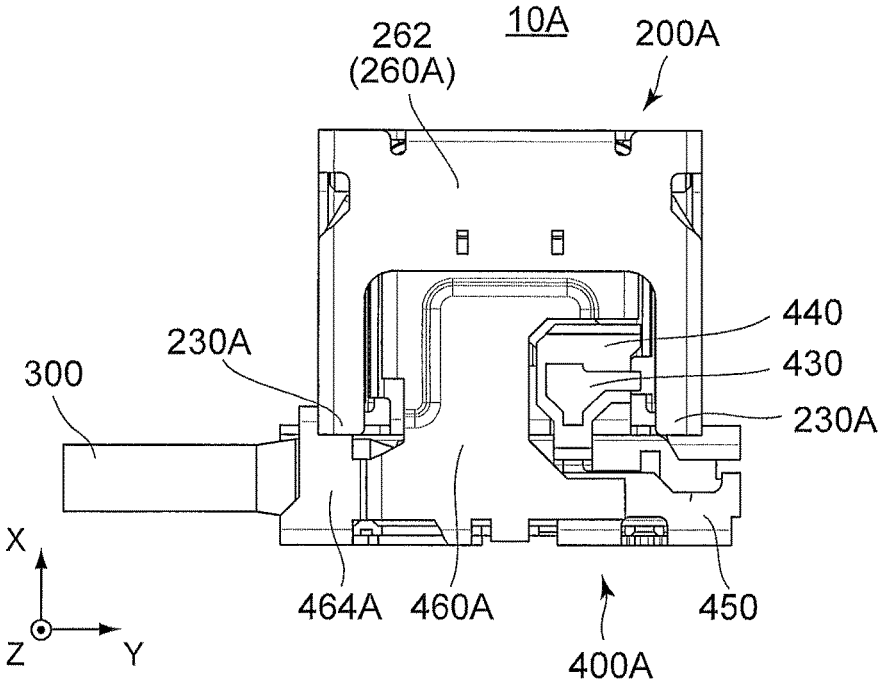
FIG. 11 is a plan view showing the first connector and the second connector of FIG. 10.

Referring to FIGS. 10 and 11, an electronic device 10A according to a second embodiment of the present invention has a first connector 200A and a second connector 400A. The first connector 200A and the second connector 400A have approximately same structures as those of the first connector 200 and the second connector 400 of the first embodiment, respectively. Hereinafter, dissimilarities between the first connector 200A and the first connector 200 of the first embodiment and dissimilarities between the second connector 400A and the second connector 400 of the first embodiment will be described.

As shown in FIGS. 10 and 11, the first connector 200A has a shell 260A with protruding portions 230A. One of the protruding portions 230A functions as the regulating portion. The protruding portions 230A do not have decrement portions like the decrement portions 232 (see FIG. 7) which are provided to the regulating portions 230 of the first embodiment. Accordingly, as apparent from comparison of FIG. 11 with FIG. 7, the protruding portions 230A define receiving portions 220A which are shorter than the receiving portions 220 of the first embodiment in the front-rear direction. On the other hand, the second connector 400A has a cable attaching portion 420A and an upper plate 460A. The upper plate 460A has a cable protection portion 464A in the cable attaching portion 420A as shown in FIGS. 10 and 11. As apparent from comparison of FIG. 11 with FIG. 7, the cable protection portion 464A is longer than the cable protection portion 464 of the first embodiment in the front-rear direction. With this structure, also in the present embodiment, the regulating portion 230A is positioned above the cable protection portion 464A and overlaps with the cable protection portion 464A in the up-down direction. Accordingly, also in the electronic device 10A of the present embodiment, effects similar to those of the first embodiment are obtained. Additionally, in the present embodiment, the shell 260A can be simplified in shape, and the first connector 200A can be downsized and reduced in weight.

Third Embodiment

Figure 12:
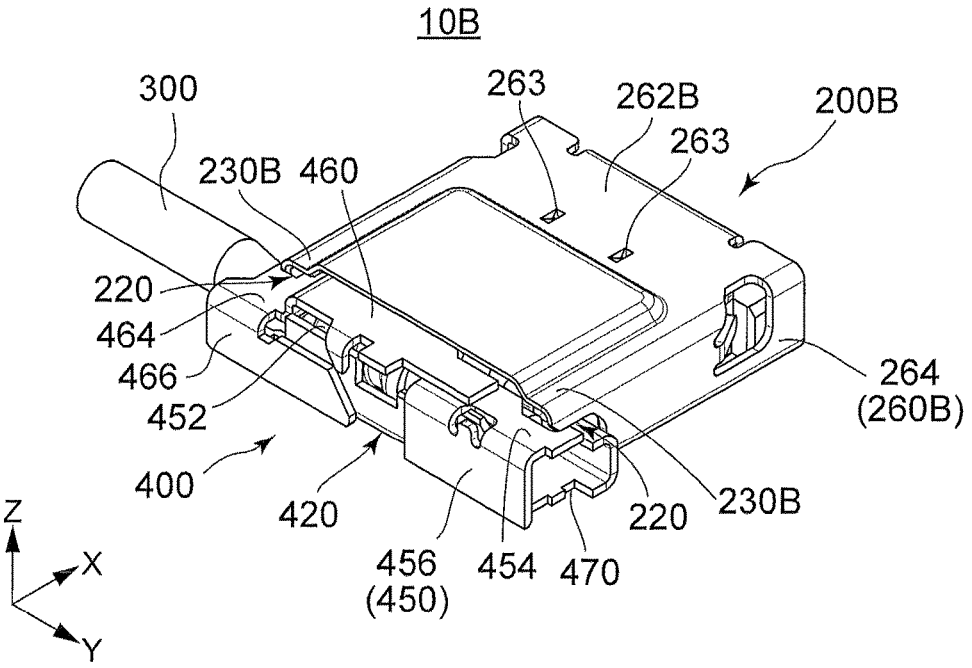
FIG. 12 is a perspective view showing a first connector and a second connector which are included in an electronic device according to a third embodiment of the present invention. The first connector and the second connector are in a mated state.
Figure 13:
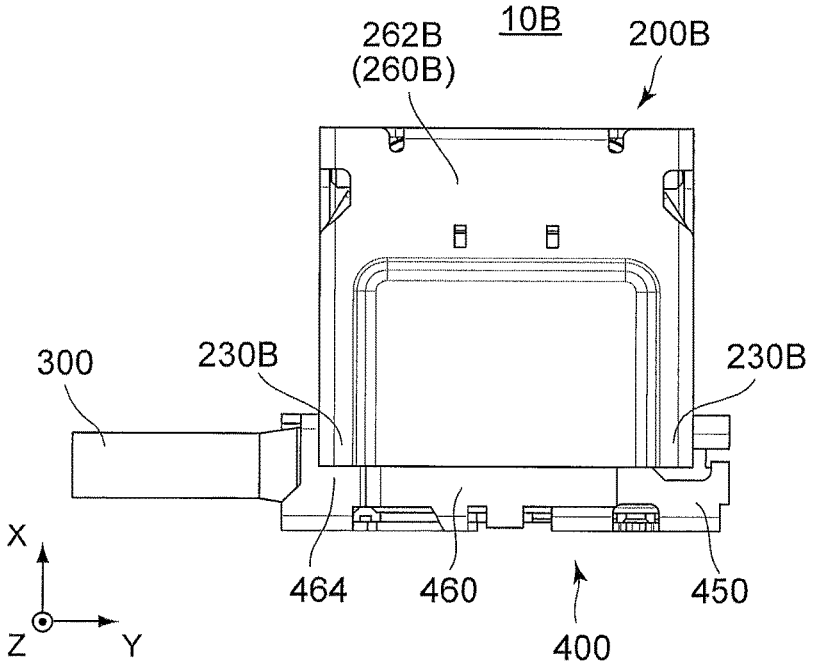
FIG. 13 is a plan view showing the first connector and the second connector of FIG. 12.

Referring to FIGS. 12 and 13, an electronic device 10B according to a third embodiment of the present invention has a first connector 200B and the second connector 400. The first connector 200B has an approximately same structure as that of the first connector 200 of the first embodiment. Hereinafter, dissimilarities between the first connector 200B and the first connector 200 will be described.

As shown in FIGS. 12 and 13, the first connector 200B has a shell 260B. The shell 260B has an upper surface portion 262B. The upper surface portion 262B is an about rectangular in shape when seen along the up-down direction. In the first embodiment, the accommodating portion 210 opens upward in part as shown in FIG. 7. In contrast, as shown in FIGS. 12 and 13, the accommodating portion 210 of the present embodiment is closed upward. Accordingly, when seen from above in the up-down direction, the first terminals 240 (see FIG. 1) and the first holding member 250 (see FIG. 1) are invisible. The shell 260B has protruding portions 230B. The protruding portions 230B and the upper surface portion 262B are continued from one another in the lateral direction. The protruding portions 230B have front ends while the upper surface portion 262B has a front edge. The front ends of the protruding portions 230B and the front edge of the upper surface portion 262B are identical to each other in position in the front-rear direction. With this structure, the electronic device 10B of the present embodiment can protect the first terminals 240 (see FIG. 1) and the first holding member 250 (see FIG. 1) against the outside in addition to the effects of the first embodiment. Moreover, in a state that the first connector 200B and the second connector 400 are mated with each other, the accommodated portion 410 (see FIG. 1) of the second connector 400 can be protected against the outside.

Forth Embodiment

Figure 14:
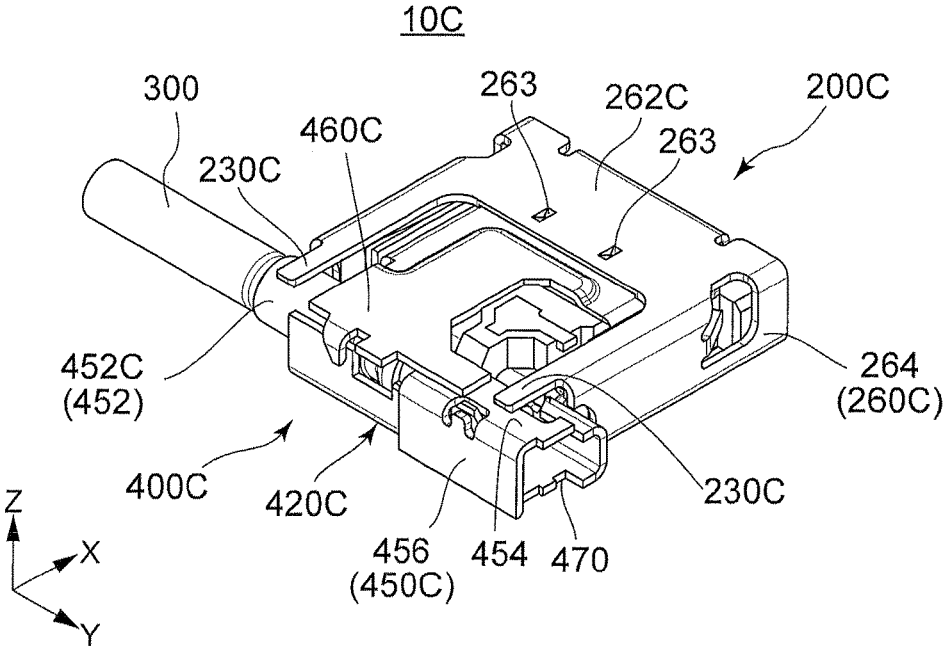
FIG. 14 is a perspective view showing a first connector and a second connector which are included in an electronic device according to a fourth embodiment of the present invention. The first connector and the second connector are in a mated state.
Figure 15:
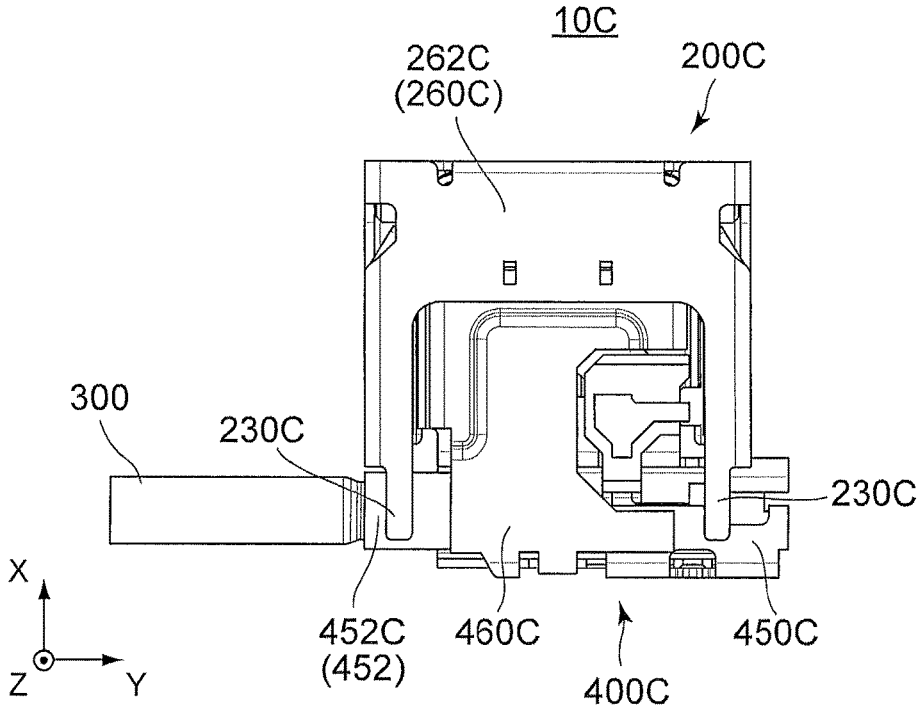
FIG. 15 is a plan view showing the first connector and the second connector of FIG. 14.

Referring to FIGS. 14 and 15, an electronic device 10C according to a forth embodiment of the present invention has a first connector 200C and a second connector 400C. The first connector 200C and the second connector 400C have approximately same structures as those of the first connector 200 and the second connector 400 of the first embodiment, respectively. Hereinafter, dissimilarities between the first connector 200C and the first connector 200 of the first embodiment and dissimilarities between the second connector 400C and the second connector 400 of the first embodiment will be described.

As shown in FIGS. 14 and 15, the first connector 200C has a shell 260C with protruding portions 230C. The protruding portions 230C protrude forward from vicinities of both ends of an upper surface portion 262C in the lateral direction. Each of the protruding portions 230C has an I-shaped cross section in a plane perpendicular to the front-rear direction. In other words, the protruding portion 230C has a shape of a flat plate. Also, the protruding portion 230C has a constant width in the lateral direction.

As understood from FIGS. 14 and 15, the second connector 400C has a cable attaching portion 420C and an upper plate 460C. The upper plate 460C in the cable attaching portion 420C does not have a cable protection portion like the cable protection portion 464 (see FIG. 1). In addition, the cable attaching portion 420C has a fixing plate 450C. The part 452 of the fixing plate 450C has an extension portion 452C protruding in the lateral direction from between the upper plate 460C and the lower plate 470. In a mated state that the first connector 200C and the second connector 400C are mated with each other, one of the protruding portions 230C, i.e. the regulating portion, is positioned above the extension portion 452C of the fixing plate 450C in part and overlaps with the extension portion 452C in the up-down direction. When the cable 300 is swung, the regulating portion 230C regulates the movement of the cable 300 through the extension portion 452C. In other words, the extension portion 452C functions as a cable protection portion for protecting a cable lead-out portion of the second connector 400C. Thus, in the electronic device 100 of the present embodiment, the cable lead-out portion of the second connector 400C is prevented from being damaged.

Fifth Embodiment

Figure 16:
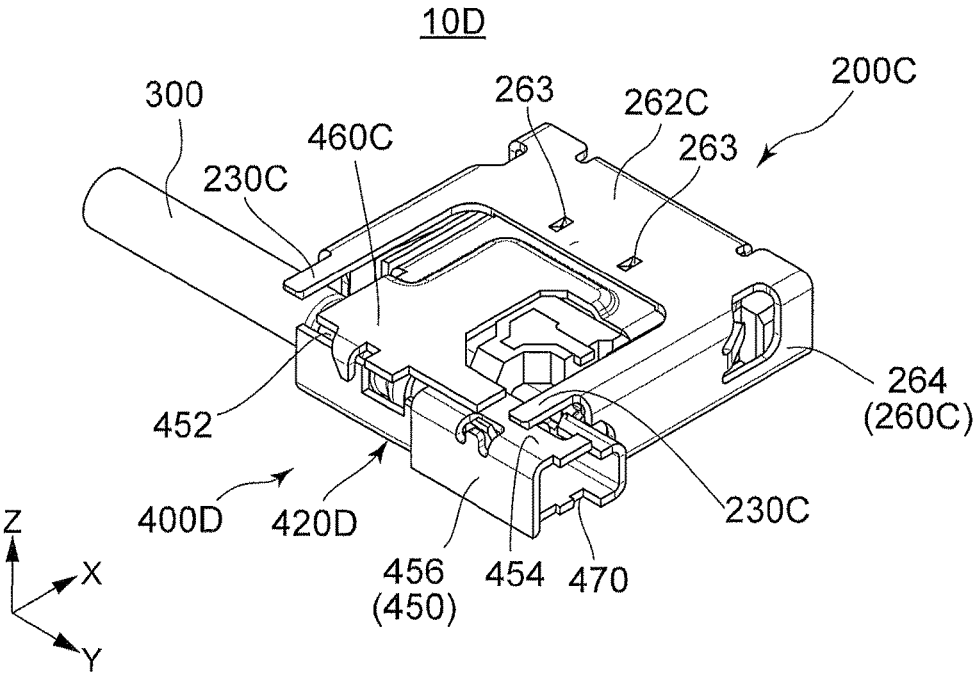
FIG. 16 is a perspective view showing a first connector and a second connector which are included in an electronic device according to a fifth embodiment of the present invention. The first connector and the second connector are in a mated state.
Figure 17:
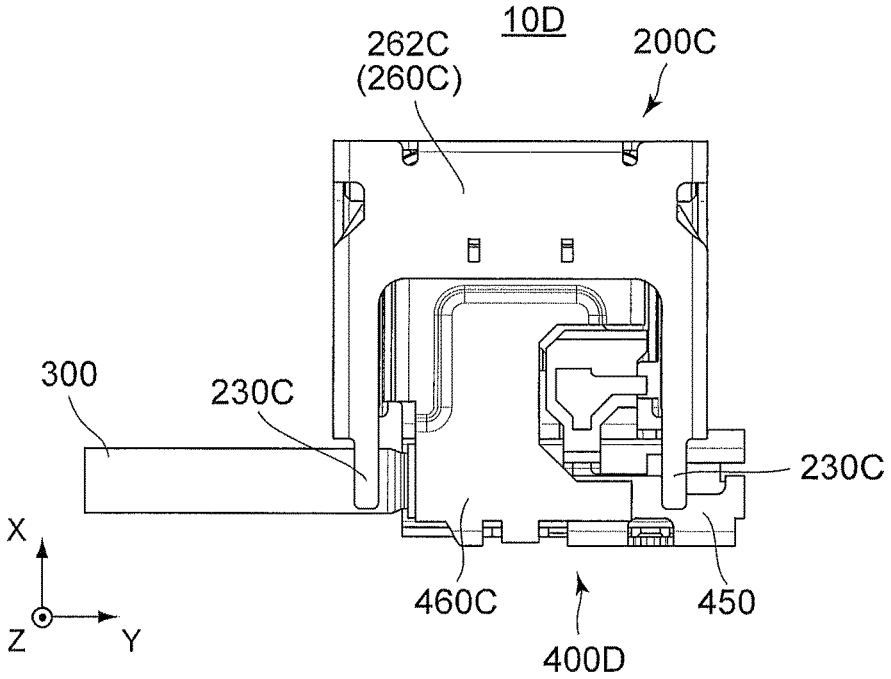
FIG. 17 is a plan view showing the first connector and the second connector of FIG. 16.
Figure 18:
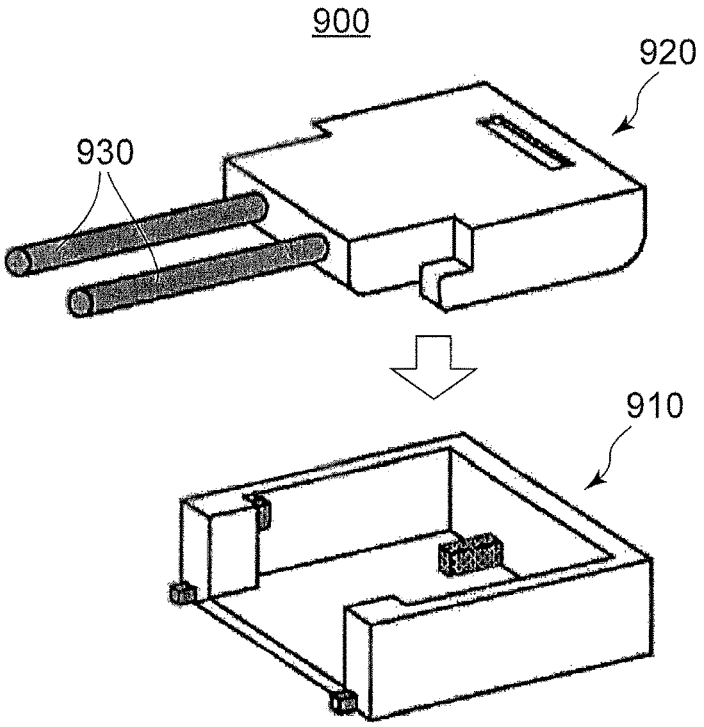
FIG. 18 PRIOR ART
FIG. 18 is a perspective view showing a connector of Patent Document 1.

Referring to FIGS. 16 and 17, an electronic device 10D according to a fifth embodiment of the present invention has the first connector 200C and a second connector 400D. The second connector 400D has an approximately same structure as that of the second connector 400C of the fourth embodiment. Hereinafter, dissimilarities between the second connector 400D and the second connector 400C of the forth embodiment will be described.

As shown in FIGS. 16 and 17, the second connector 400D has a cable attaching portion 420D and an upper plate 460C. The upper plate 460C in the cable attaching portion 420D does not have a cable protection portion like the cable protection portion 464 (see FIG. 1). In a mated state that the first connector 200C and the second connector 400D are mated with each other, one of the protruding portions 230C, i.e. the regulating portion, is positioned above the cable 300 in part and overlaps with the cable 300 in the up-down direction. When the cable 300 is swung, the regulating portion 230C directly regulates the movement of the cable 300 without an intervention of the cable protection portion 464. Thus, in the electronic device 10D of the present embodiment, a cable lead-out portion of the second connector 400D is prevented from being damaged.

While there has been described what is believed to be the preferred embodiment of the invention, those skilled in the art will recognize that other and further modifications may be made thereto without departing from the spirit of the invention, and it is intended to claim all such embodiments that fall within the true scope of the invention. For example, in the aforementioned embodiment, the cable attaching portion 420 is composed of three metal plates, i.e. the fixing plate 450, the part of the upper plate 460 and the part of the lower plate 470. However, the cable attaching portion 420 may be composed of a single metal plate, two metal plates or four or more metal plates. In such a case, the cable protection portion 464 may be formed by a part of any one metal plate.

What is claimed is:

1. An electronic device comprising:

a circuit board;

a first connector mounted on the circuit board;

a cable having a protected portion; and a second connector attached to the cable, wherein:

the second connector is mateable with and removable from the first connector along a front-rear direction;

the second connector has a cable protection portion to protect the protected portion of the cable;

the cable protection portion is located on the protected portion in an up-down direction perpendicular to the front-rear direction in a state that the second connector is mated with the first connector;

the cable is led out from the cable protection portion in a direction intersecting with the front-rear direction;

the first connector has a receiving portion and a regulating portion;

the receiving portion receives the cable protection portion at least in part in the state that the second connector is mated with the first connector; and the regulating portion is positioned above the cable protection portion and overlaps with the cable protection portion in the up-down direction in the state that the second connector is mated with the first connector.

2. The electronic device as recited in claim 1, wherein the regulating portion further overlaps with the protected portion of the cable in the up-down direction in the state that the second connector is mated with the first connector.

3. The electronic device as recited in claim 1, wherein:

the second connector comprises a supporting portion which supports at least the protected portion of the cable, and the protected portion is sandwiched between the cable protection portion and the supporting portion to be deformed.

4. The electronic device as recited in claim 1, wherein:

the first connector has a plurality of contact points;

the contact points are arranged in a lateral direction perpendicular to both of the front-rear direction and the up-down direction; and the regulating portion is located outward of the contact points in the lateral direction.

5. The electronic device as recited in claim 1, wherein the regulating portion has an L-shaped cross-section in a plane perpendicular to the front-rear direction.

6. The electronic device as recited in claim 1, wherein:

the first connector has a shell; and the regulating portion is a part of the shell.

7. The electronic device as recited in claim 1, wherein:

the first connector has a soldered portion; and the soldered portion is soldered on the circuit board.

8. The electronic device as recited in claim 1, wherein:

the first connector has a contact point and a lock protrusion which is used to lock the state that the second connector is mated with the first connector;

the contact point and the lock protrusion protrude upward and downward, respectively, in the up-down direction; and the lock protrusion is located between the regulating portion and the contact point in the front-rear direction.

9. The electronic device as recited in claim 1, wherein;

the first connector has an accommodating portion;

the second connector has an accommodated portion;

when the first connector is mated with the second connector, the accommodated portion is accommodated in the accommodating portion at least in part; and the cable protection portion and the regulating portion are located outward of the accommodating portion and the accommodated portion in a lateral direction perpendicular to both of the front-rear direction and the up-down direction.

10. A connector mateable with a mating connector along a front-rear direction, the mating connector attached to a cable having a protected portion, wherein:

the mating connector has a cable protection portion to protect the protected portion of the cable;

the cable protection portion is located on the protected portion in an up-down direction perpendicular to the front-rear direction in a state that the mating connector is mated with the connector;

the cable is led out from the cable protection portion in a direction intersecting with the front-rear direction;

the connector has a receiving portion and a regulating portion;

the receiving portion receives the cable protection portion at least in part in the state that the mating connector is mated with the connector; and the regulating portion is located above the receiving portion and overlaps with the receiving portion in the up-down direction.

* * * * *